US007392672B2

(12) United States Patent
Kim et al.

(10) Patent No.: US 7,392,672 B2
(45) Date of Patent: Jul. 1, 2008

(54) PULSATOR AND WASHING MACHINE USING THE SAME

(75) Inventors: Jong Ho Kim, Changwon-shi (KR); Jong Sun Yoon, Jinju-shi (KR)

(73) Assignee: LG Electronics Inc., Seoul (KR)

( * ) Notice: Subject to any disclaimer, the term of this patent is extended or adjusted under 35 U.S.C. 154(b) by 425 days.

(21) Appl. No.: 10/414,014

(22) Filed: Apr. 16, 2003

(65) Prior Publication Data

US 2003/0200774 A1 Oct. 30, 2003

(30) Foreign Application Priority Data

Apr. 17, 2002 (KR) ..... 10-2002-0021037
Apr. 17, 2002 (KR) ..... 10-2002-0021038
Apr. 17, 2002 (KR) ..... 10-2002-0021039
Aug. 5, 2002 (KR) ..... 10-2002-0046136
Aug. 5, 2002 (KR) ..... 10-2002-0046137

(51) Int. Cl.
*D06F 13/00* (2006.01)

(52) U.S. Cl. ..... 68/134; 68/18 FA; 68/23.7; 68/53; 68/132; 68/133

(58) Field of Classification Search ..... 68/4, 68/53, 18 FA, 23.7, 131–134; 210/461
See application file for complete search history.

(56) References Cited

U.S. PATENT DOCUMENTS 2,416,616 A * 2/1947 Deutsch ..... 68/4
2,829,276 A 1/1958 Jarret et al.
5,746,070 A * 5/1998 Bailey et al. ..... 68/24
5,829,276 A * 11/1998 Suh et al. ..... 68/53
5,850,750 A * 12/1998 Cho ..... 68/133
5,906,116 A * 5/1999 Kim et al. ..... 68/53

(Continued)

FOREIGN PATENT DOCUMENTS

BE 517430 2/1953

(Continued)

OTHER PUBLICATIONS

European Search Report dated Dec. 21, 2005.

(Continued)

*Primary Examiner*—Michael Barr
*Assistant Examiner*—Rita R Patel
(74) *Attorney, Agent, or Firm*—McKenna Long & Aldridge LLP

(57) ABSTRACT

A pulsator includes a metallic upper pulsator having an inlet at a center of the pulsator and upwardly protruding upper washing ribs radially around the inlet and a synthetic resin lower pulsator having upwardly protruding lower washing ribs and contacting a lower surface of the upper washing ribs, a guidance surface spaced apart from the lower surface of the upper pulsator and defining a flow passage for channeling water introduced through the inlet, and an outlet at an end of the guidance surface discharging water channeled through the flow passage. The lower pulsator rotates with and is fixed to a driving shaft of a washing machine. A pulsator includes a synthetic resin pulsator body having a washing rib and a metal plating layer on an outer surface of the pulsator body includes the inlet. The outlet and the flow passage are provided in the pulsator body.

48 Claims, 9 Drawing Sheets

U.S. PATENT DOCUMENTS

| | | | | |
|---|---|---|---|---|
| 6,070,439 | A | 6/2000 | Jung | |
| 6,210,573 | B1 * | 4/2001 | Marshall | 210/238 |

FOREIGN PATENT DOCUMENTS

| | | |
|---|---|---|
| CN | 2222728 | 3/1996 |
| CN | 2318243 | 5/1999 |
| EP | 01-146575 | 8/1989 |
| JP | 52120567 | 10/1977 |
| JP | 63-36478 | 3/1988 |
| JP | 05-131079 | 5/1993 |
| JP | 07-124366 | 5/1995 |
| JP | 07-163778 | 6/1995 |
| JP | 09010466 | 1/1997 |
| JP | 9299682 | 11/1997 |
| JP | 2000-033196 | 2/2000 |

OTHER PUBLICATIONS

Japanese Office Action dated Dec. 6, 2005.

* cited by examiner

PULSATOR AND WASHING MACHINE USING THE SAME

This application claims the benefit of Korean Patent Application Nos. P2002-21037, filed on Apr. 17, 2002, P2002-21038, filed on Apr. 17, 2002, P2002-21039, filed on Apr. 17, 2002, P2002-46136, filed on Aug. 5, 2002, and P2002-46137, filed on Aug. 5, 2002, which is hereby incorporated by reference for all purposes as if fully set forth herein.

BACKGROUND OF THE INVENTION

1. Field of the Invention

The present invention relates to a washing machine, and more particularly, to a pulsator provided at a lower portion of a tub to form a water movement during its rotation and to a washing machine using the same.

2. Discussion of the Related Art

Generally, using water and detergent, washing machines are capable of performing washing, rinsing, and dewatering operations to separate dirt from clothes. Washing machines are typically classified into agitator, pulsator, and drum-type washing machines.

Agitator-type washing machines wash laundry by rotating a washing rod at the center of a washing tub in forward and reverse directions. Agitator-type washing machines have an excellent washing capabilities but are loud, generate excessive vibration, and can damage laundry.

Drum-type washing machines wash laundry by loading water, detergent, and laundry into a drum having a plurality of protruding tumbling ribs installed at an inner surface of the drum and rotating the drum at a low speed. Drum-type washing machines do not damage laundry, consume a small amount of water, and, after the washing operation is complete, laundry is not entangled. However, drum-type washing machines are deleteriously loud, consume a large amount of power, and require a relatively long amount of time to adequately wash laundry.

Pulsator-type washing machines wash laundry using forces generated between moving water and the laundry, wherein the water movement is typically generated by a disk-shaped pulsator rotating in forward and reverse directions. Pulsator-type washing machines have excellent washing capacities and can wash laundry in a relatively short amount of time. Further, pulsator-type washing machines generate a relatively low amount of noise and vibration and are inexpensive. Newly developed pulsator-type washing machines are able to avoid previously encountered problems of entangling and damaging laundry by replacing clutch-type driving systems with direct driving systems.

FIG. 1 illustrates a partial sectional view of a related art pulsator-type washing machine.

Referring to FIG. 1, a cylindrical outer tub (not shown) is provided within a cabinet 1 for containing water. An inner tub 2, rotatably provided within the outer tub, includes a plurality of holes 2*a* enabling water to flow between the inner and outer tubs. A pulsator 3 is provided at the inner, bottom region of the inner tub 2 and is coupled to a driving shaft (not shown) that is rotatable by means of a motor (not shown). A plurality of upwardly protruding washing ribs 3*a* are arranged on an upper surface of the pulsator 3 and radiate from the center of the pulsator 3. During operation, the pulsator 3 rotates in forward and reverse directions to move water horizontally to perform a washing operation. A top cover 4 is provided at an upper portion of the cabinet 1 and includes a lid 5 for closing/opening an opening exposing the interior of the washing machine. A filtering mesh 6 is provided for filtering lint generated during the washing operation.

When the pulsator 3 rotates, the horizontally moving water generates a friction capable of washing the laundry. Importantly, the direction of the moving water and energy generated by its movement heavily influences the capability of pulsator-type washing machines to effectively wash laundry. Since the water movement is primarily generated by the washing ribs 3*a*, there is generally a limit to the direction water can be moved. Specifically, movement of the washing ribs 3*a* can be controlled to adjust the horizontal direction the water moves and the energy associated by its horizontal movement. However, the washing ribs 3*a* are limited in their ability to effectively control any vertical movement of water, let alone the energy associated with its vertical movement.

Accordingly, in order to improve the performance of the pulsator-type washing machine, an improved pulsator, capable of creating highly energetic motion; in the water along both vertical and horizontal directions, must be provided.

In the related art pulsator washing machine described above, inner and outer surfaces of the inner tub 2 are covered by water. Accordingly, the inner tub 2 is formed out of a material having a strong corrosion resistance and a high metallic gloss such as stainless steel. The pulsator 3, provided at the lower portion of the inner tub 2 and moving the water, however, is formed of a synthetic resin having no metallic gloss. Accordingly, the interior of the related art pulsator-type washing machine has a low aesthetic quality due to the difference in material surface finishes.

Moreover, when the synthetic resin pulsator 3 rotates, metallic objects included within the laundry (e.g., buttons, zipper, coins, keys, etc.) often strike the upper surface of the pulsator 3, creating scratches and burrs on the upper surface of the synthetic resin pulsator 3. As a result, laundry may become damaged due to the scratches and burrs, and a large amount of lint may be generated during the washing operation.

SUMMARY OF THE INVENTION

Accordingly, the present invention is directed to a pulsator and a washing machine having a pulsator that substantially obviates one or more of the problems due to limitations and disadvantages of the related art.

An advantage of the present invention provides a pulsator and a washing machine having a pulsator with an upper surface that is substantially resistant to the formation of scratches or burrs.

Another advantage of the present invention provides a pulsator having an upper surface having a metallic finish thereby improving an aesthetic quality of the washing machine.

Another advantage of the present invention provides an improved pulsator and a washing machine using the improved pulsator that is capable of creating highly energetic motion in water along both vertical and horizontal directions.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a pulsator of a washing machine may, for example, include an upper pulsator made of a metallic material, wherein the upper pulsator includes an upwardly protruding inlet provided at a center of the upper pulsator and upper washing ribs protruding upwardly and extending radially outward from the inlet; and a lower pulsator made of a synthetic resin material, wherein the lower pulsator includes plurality of lower washing ribs protruding upwardly and contacting a lower surface of the upper washing ribs, and wherein the lower pulsator further includes a guidance surface spaced apart from the lower surface of the upper pulsator, a flow passage formed between the upper pulsator and the guidance surface for channeling water introduced through the inlet, and an outlet formed at an end of the guidance surface wherein water channeled the flow passage flows downwardly, and wherein the lower pulsator rotates and is fixed to a driving shaft of the washing machine.

In one aspect of the present invention, the upper pulsator may, for example, be formed of a material having a high corrosion resistance and metallic gloss such as stainless steel.

In another aspect of the present invention, an edge of the upper pulsator may be bent and fixed to enclose an edge of the lower pulsator, wherein the upper pulsator becomes substantially inseparable from the lower pulsator.

In yet another aspect of the present invention, the lower pulsator may further include a lower impeller protruding downwardly from a lower surface at a position adjacent the outlet for forcing water flowing from the outlet away from the center of the pulsator by a centrifugal force generated by a rotation of the pulsator.

In still another aspect of the present invention, the flow passage may, for example, be arranged between the lower washing ribs, and the outlet may be arranged along a circumferential edge of the guidance surface.

In one aspect of the present invention, the upper and lower pulsators may further include, for example, a plurality of communication holes penetrating the upper and lower pulsators such that a space above the upper pulsator communicates with a space below the lower pulsator via the communication holes. The plurality of communication holes may be formed at a portion adjacent a circumferential edge of the upper and lower pulsators.

In another aspect of the present invention, the lower pulsator may further include, for example, a guidance rib contacting a lower surface of the upper pulsator at a location between the outlet and a circumferential edge of the lower pulsator, wherein the guidance rib substantially prevents water introduced through the inlet and channeled by the flow passage from being introduced into an edge portion between the upper and lower pulsators and guides the water through the outlet.

In still another aspect of the present invention, the lower pulsator may further include protrusions formed at an outer side surface of the lower washing ribs for contacting an inner side surface of the upper washing ribs of the upper pulsator wherein the protrusions prevent any relative horizontal movement between the upper and lower pulsators caused by a gap between the upper and lower pulsators. The protrusions may be symmetric with both side surfaces of the lower pulsator. The protrusions may be provided at an upper surface of the lower pulsator not on the lower washing ribs. Each of the protrusions may be substantially polygonal.

In one aspect of the present invention, the pulsator may further include a filtering unit detachably fixable within the inlet, wherein the filtering unit collects lint contained in the water and introduced into the inlet.

In another aspect of the present invention, the filtering unit may include a cylindrical casing detachably fixable within the inlet; a cap detachably fixable to an opened upper portion of the cylindrical casing and having a plurality inlet holes; and a collecting mesh provided within the casing for collecting the lint contained in the water introduced into the inlet. In an alternate aspect of the present invention, the filtering unit may include a cylindrical casing detachably fixable with the inlet; a cap detachably fixable to an opened upper portion of the cylindrical casing and having a plurality inlet holes; and a filter provided at a lower portion of the casing, for collecting lint contained in the water introduced into the inlet. In each of the filtering units described above, the cylindrical casing and the cap may be detachably fixable to the inlet and the casing, respectively, by a hook.

In one aspect of the present invention, the upper and lower pulsators may, for example, include a groove provided in the washing rib, wherein the groove is capable of preventing a localized wrinkle or other distortion from being created due to a difference in the modulus of elongation during a pressing operation, and for increasing strength of the upper washing rib, wherein the groove formed in the lower washing rib does not interference with the groove of the upper washing rib.

In another aspect of the present invention, a washing machine comprising may, for example, include a cabinet; a tub provided in the cabinet; a driving shaft penetrating a lower surface of the tub and rotatable by a motor; an upper pulsator made of a metallic material, wherein the upper pulsator includes an upwardly protruding inlet provided at a center of the upper pulsator and upper washing ribs protruding upwardly and extending radially outward from the inlet; and a lower pulsator made of a synthetic resin material, wherein the lower pulsator includes plurality of lower washing ribs protruding upwardly and contacting a lower surface of the upper washing ribs, and wherein the lower pulsator further includes a guidance surface spaced apart from the lower surface of the upper pulsator, a flow passage formed between the upper pulsator and the guidance surface for channeling water introduced through the inlet, and an outlet formed at an end of the guidance surface wherein water channeled the flow passage flows downwardly, and wherein the lower pulsator rotates and is fixed to a driving shaft of the washing machine.

In one aspect of the present invention, a lower portion of the tub may include a bottom surface to accommodate a lower portion of the lower pulsator.

In another aspect of the present invention, the bottom surface may be spaced apart from circumferential edges of the upper and lower pulsators by a predetermined distance.

In yet another aspect of the present invention, the lower pulsator may further include a lower impeller protruding downwardly from a lower surface at a position adjacent the outlet for forcing water flowing from the outlet away from the center of the pulsator by a centrifugal force and for forcing the water through the space between the bottom surface and the pulsator as the pulsator rotates.

In still another aspect of the present invention, the washing machine may further include a filtering unit detachably fixable within the inlet, wherein the filtering unit collects lint contained in the water introduced into the inlet.

To further achieve these and other advantages and in accordance with the purpose of the present invention, a pulsator of a washing machine may include a synthetic resin pulsator body coupled to a driving shaft that penetrates a lower surface of a tub and is rotatable, wherein the pulsator body includes a plurality of upwardly protruding washing ribs and a surface covered by a metal plating layer.

In one aspect of the present invention, the metal plating layer may include a material such as a chrome plating layer and may be provided at an upper surface of the pulsator body and at an outer circumferential surface of the pulsator body.

In another aspect of the present invention, the pulsator may further include an inlet penetrating the metal plating layer; an outlet provided at a lower portion of the pulsator body; and a flow passage provided within the pulsator body such that the inlet communicates with the outlet.

In still another aspect of the present invention, the inlet may be provided at an upper center portion of the pulsator and the outlet may be provided at a location adjacent a lower edge of the pulsator body.

In yet another aspect of the present invention, the pulsator may further include a filtering unit detachably fixable within the inlet, wherein the filtering unit may collect lint contained in the water introduced into the inlet.

In a further aspect of the present invention, a washing machine may, for example, include a cabinet; a tube within the cabinet; a driving shaft rotatable by a motor and penetrating a lower surface of the tub; a synthetic resin pulsator body coupled to a driving shaft, rotatable, and including a plurality of upwardly protruding washing ribs; and a metal plating layer provided on a surface of the pulsator body.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, example of which is illustrated in the accompanying drawings. Wherever possible, the same reference numbers will be used throughout the drawings to refer to the same or like parts FIGS. 2 to 9 illustrate a pulsator according to principles of a first aspect of the present invention.

Referring to FIGS. 2 to 9, a pulsator assembly 400 may, for example, include an upper pulsator 100 made of a metallic material and a lower pulsator 200 made of a non-metallic material.

Figure 1:
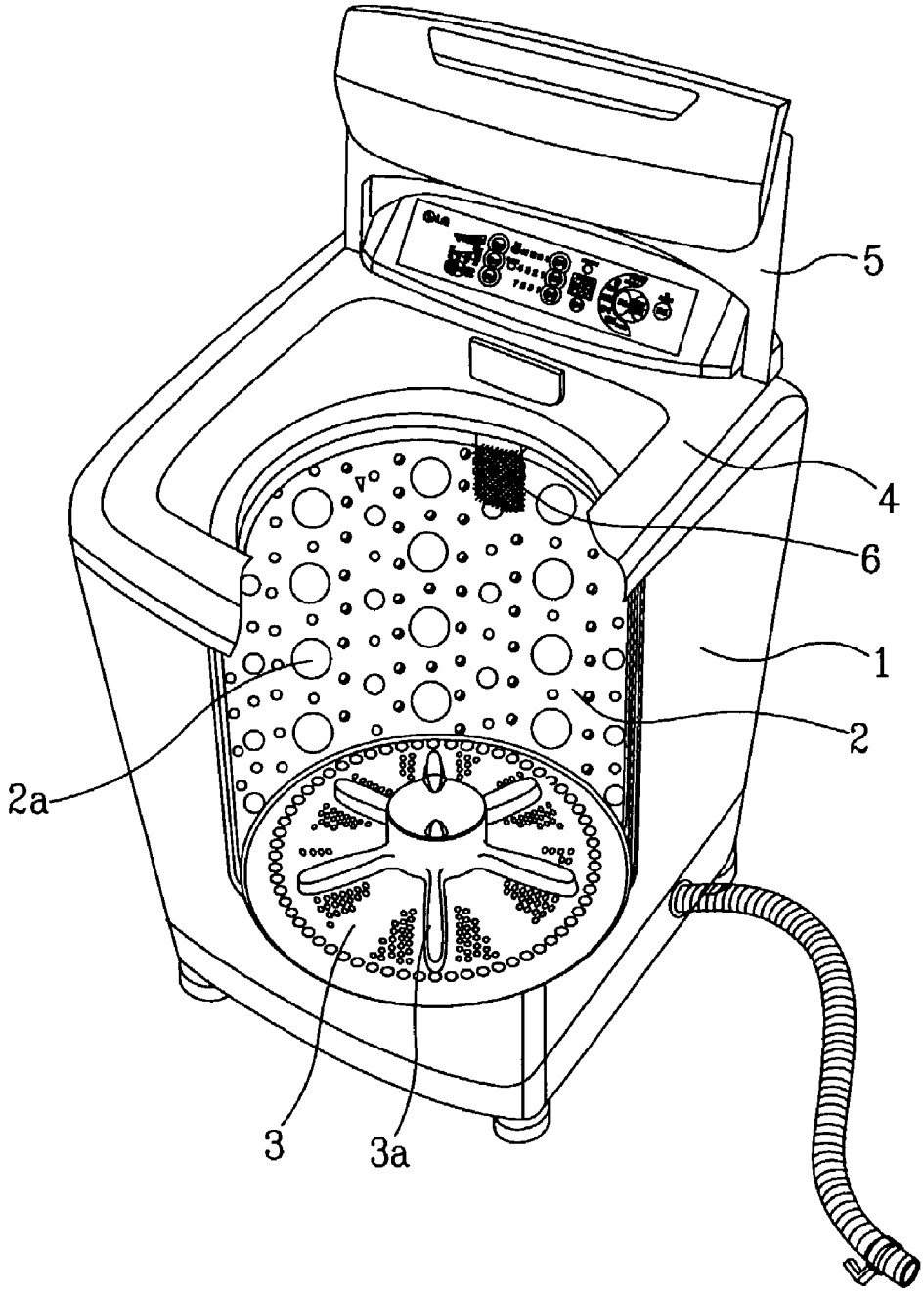
FIG.1 Related Art
FIG. 1 illustrates a cut-out perspective view of a related art pulsator-type washing machine.
Figure 2:
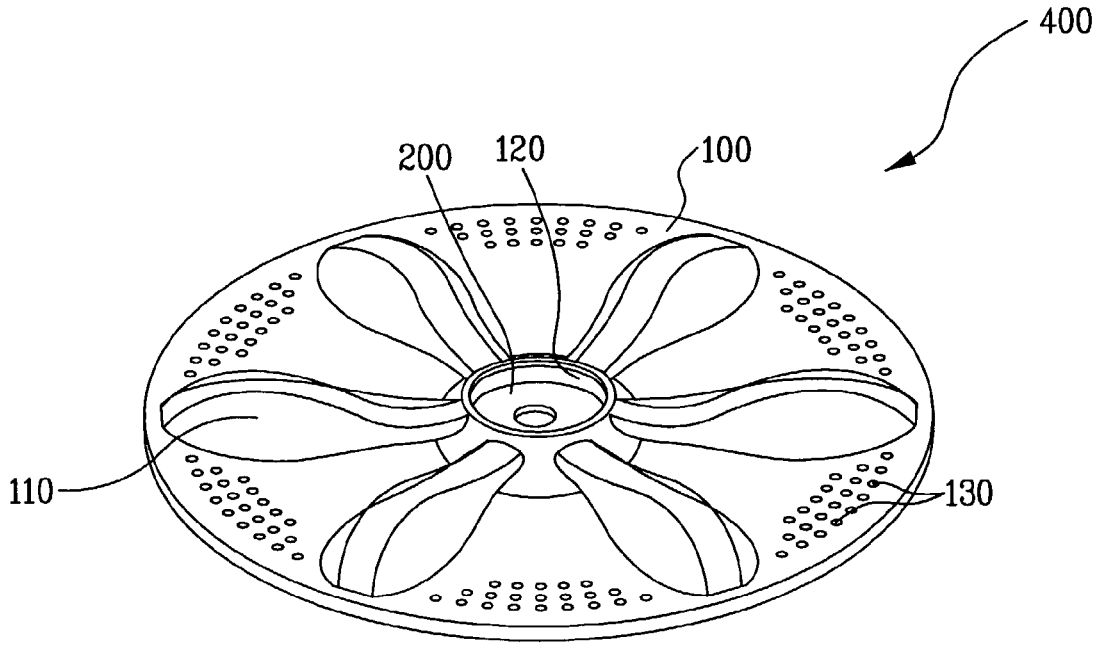
FIG. 2 illustrates a perspective view of a pulsator according to principles of a first aspect of the present invention.
Figure 3:
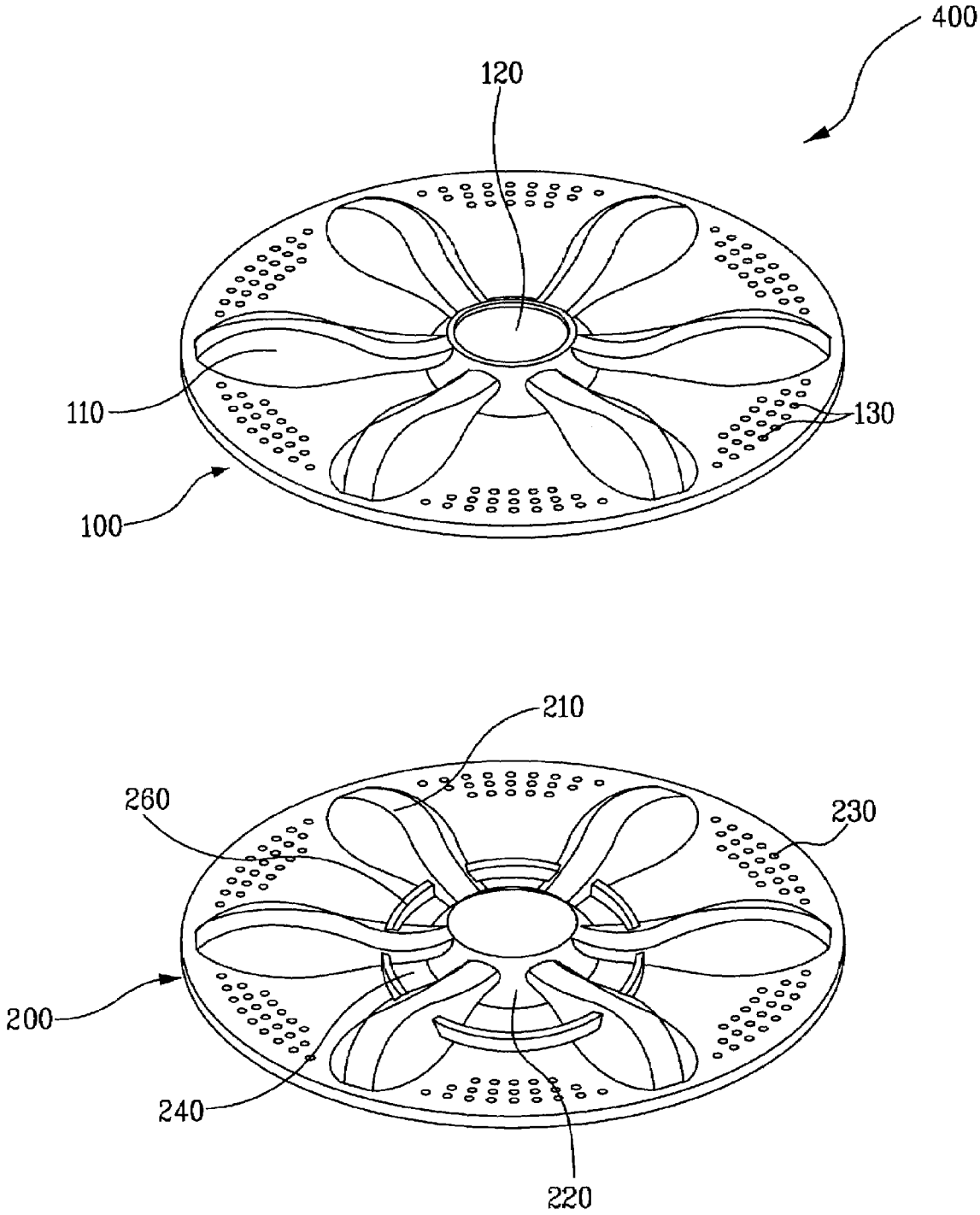
FIG. 3 illustrates an exploded perspective view of the pulsator shown in FIG. 2.

Referring specifically to FIGS. 2 to 5, the upper pulsator 100 may be provided substantially as a disk-type shape having an inlet 120 penetrating a center portion of the upper pulsator 100 and protruding from an edge of the upper pulsator 100 and defining an inclined plane on an upper surface of the upper pulsator 100. A plurality of upwardly protruding upper washing ribs 110 may extend radially from the center of the inlet 120. As shown in FIG. 2, portions of the upper washing ribs 110 adjacent the inlet 120 may be provided to be elevationally lower and narrower than portions of the upper washing ribs 110 adjacent the circumferential edge of the upper pulsator 100.

In one aspect of the present invention, the upper pulsator 100 may be fabricated by pressing a thin plate of metal material (e.g., stainless steel, etc.). Since the upper pulsator 100 is fabricated via a pressing technique, a lower surface of the upper pulsator 100 may be provided with substantially the same shape as the upper surface of the upper pulsator 100.

Additionally, the upper pulsator 100 may be provided with a plurality of communication holes 130 that enable a space above the upper pulsator 100 to communicate with a space below the upper pulsator 100. In one aspect of the present invention, the communication holes 130 may be formed between portions of the upper washing ribs 110 adjacent the circumferential edge of the upper pulsator 100.

The lower pulsator 200 may be coupled to the upper pulsator 100 and fixed to a driving shaft that is rotatable in forward and reverse directions by means of a motor. Accordingly, the lower pulsator 200 may be rotated in forward and reverse directions by the driving shaft. As will be described with greater detail below, the lower pulsator 200 may further include a plurality of lower washing ribs 210 a guidance surface 220, and an outlet 240.

The plurality of lower washing ribs 210 may extend radially from the center of the lower pulsator 200, protrude from an upper surface of the lower pulsator 200, and have a shape that is substantially conformal to the shape of the upper washing ribs 110. Accordingly, the plurality of lower washing ribs 210 have dimensions that are equal to or slightly smaller than the dimensions of the upper washing ribs 110 and may be inserted into and contact a lower, inner side of the upper washing ribs 110.

The center portion of the upper surface of the lower pulsator 200 may protrude slightly upwardly to a predetermined height, allowing the lower pulsator 200 to be spaced apart from the inlet 120 by a predetermined distance when the lower pulsator 200 is coupled to the upper pulsator 100.

Still referring to FIGS. 2 to 5, the guidance surface 220 may comprise an inclined surface sloping downwardly away from the protruded center of the upper surface of the lower pulsator 200. The guidance surface 220 may be spaced apart from a lower surface of the upper pulsator 100 by a predetermined distance to form a flow passage 250 between the guidance surface 220 and the lower surface of the upper pulsator 100 for channeling water introduced through the inlet 120. In one aspect of the present invention, the flow passage 250 may be formed between portions of the guidance surface 220 and portions of the lower surface of the upper pulsator 100 in regions between the lower washing ribs 210.

The outlet 240 may be provided at the end of the guidance surface 220 and enable the flow passage 250 to communicate with the lower surface of the lower pulsator 200. Accordingly, water introduced through inlet 120 may be channeled by and flow downwardly through the flow passage 250 and be discharged under the lower pulsator 200. In one aspect of the present invention, the outlet 240 may be arranged along the circumferential edge of the guidance surface 220.

The lower pulsator 200 may further include a guidance rib 260 for guiding the water channeled by flow passage 250 to the outlet 240. The guidance rib 260 may protrude upwardly between the outlet 240 and the circumferential edge of the lower pulsator 200 to guide water toward the outlet 240 and substantially prevents water introduced through the inlet 120 and channeled by the flow passage 250 from being introduced into an edge portion between the upper and lower pulsators 100 and 200. In one aspect of the present invention, the guidance rib 260 may be formed to predetermined height such that an upper portion of the guidance rib 260 contacts the lower surface of the upper pulsator 100 when the upper pulsator 100 and the lower pulsator 200 are coupled to each other.

The lower pulsator 200 may further include a plurality of communication holes 230 that enable a space above the lower pulsator 200 to communicate with a space below the lower pulsator 200. The communication holes 230 formed in the lower pulsator 200 may be substantially aligned with the communication holes 130 formed in the upper pulsator 100 such that a space above the upper pulsator 100 may communicate with a space below the lower pulsator 200. Accordingly, when the communication holes 130 and 230 are aligned, water can flow from above the upper pulsator 100 to below the lower pulsator 200 via the communication holes 130 and 230.

In one aspect of the present invention, the lower pulsator 200 may be formed out of a synthetic resin material. In one aspect of the present invention, the lower pulsator 200 may be provided as an integral workpiece including the flow passage 250, outlet 240, and guidance rib 260. In another aspect of the present invention, the lower pulsator 200 may be fabricated through an injection molding process or other suitable process.

According to the principles of the present invention, the upper and lower pulsators 100 and 200, respectively, may be coupled together to form a pulsator assembly 400. In one aspect of the present invention, the upper and lower pulsators 100 and 200, respectively, of the pulsator assembly 400 should be substantially inseparable when used in a washing machine. Accordingly, an edge (e.g., a circumferential edge) of the upper pulsator 100 may be bent to enclose a corresponding edge (e.g., a circumferential edge) of the lower pulsator 200, thereby fixing the upper pulsator 100 to the lower pulsator 200. Once fixed together, the bent edge of the upper pulsator 100 prevents both the upper and lower pulsators 100 and 200 from being vertically separated from each other while the upper and lower washing ribs 110 and 210, respectively, substantially limit any relative horizontal movement between the upper and lower pulsators 100 and 200. Accordingly, the upper and lower pulsators 100 and 200 of the pulsator assembly 400 may move substantially in unison while being substantially inseparable.

According to the principles of the present invention, as the upper pulsator 100 is fabricated by pressing a thin metallic plate, the structural rigidity of the upper washing ribs 110, protruding from the pulsator assembly 400 much more than other portions, may be significantly degraded during use. The upper washing ribs 110 directly contact the water and move the water. Therefore, if the structural rigidity of the upper washing ribs 110 becomes compromised, plastic deformation in the upper thin metallic plate may occur and possibly result in the formation of cracks.

While not wishing to be bound by any particular theory, it is postulated that, after pressing the thin metallic plate, localized wrinkles and other distortions may be generated according to shapes pressed into the thin metallic plate. These localized wrinkles and distortions may be the result of differences in the modulus of elongation in the plastically deformed portions of the thin metallic plate created during the pressing process. The localized wrinkles and distortions may occur at areas where the modulus of elongation is relatively low, aesthetically detract from the appearance of the pulsator assembly 400, and yield an upper pulsator 200 having dimensions undesirably outside imposed tolerances. Accordingly, when coupled to the lower pulsator 200, fabricated by an injection molding process yielding accurate dimensions, an upper pulsator 100 having inaccurate dimensions may cause failure in the pulsator assembly 400. Therefore, the design of the pulsator assembly 400 illustrated in FIGS. 2 and 3 may be revised design to avoid the aforementioned problems.

Figure 4:
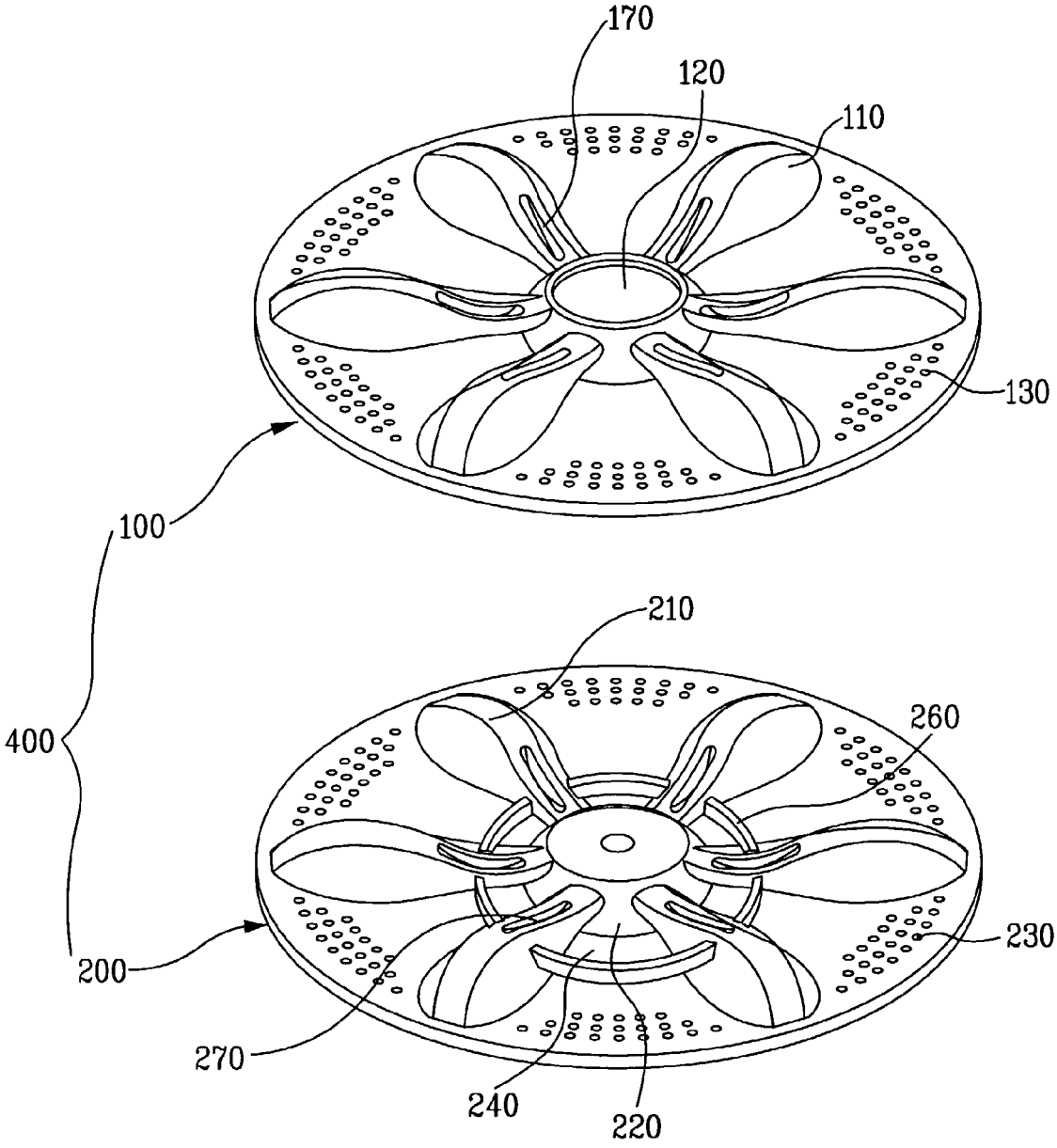
FIG. 4 illustrates an exploded perspective view of a pulsator shown in FIG. 3 wherein a groove is added for structurally reinforcing the pulsator.

Referring now to FIG. 4, upper and lower pulsators 100 and 200 of a pulsator assembly 400 having such a revised design is illustrated. The upper pulsator 100 incorporating the revised design may be substantially the same as the upper pulsator 100 shown in FIGS. 2 and 3 and may further include grooves 170 extending downwardly from an upper surface of the upper washing ribs 110. In one aspect of the present invention, the grooves 170 may be formed during the pressing of the thin metallic plate. The grooves 170 may be provided in the upper surface of the upper washing ribs 110 in regions near the center of the upper pulsator 100. The portions of the upper washing ribs 110 near the center of the upper pulsator 100 are lower and narrower than portions of the upper washing ribs 110 near the circumferential edge of the upper pulsator 100 and therefore have a small modulus of elongation during the pressing process. Accordingly, if the grooves 170 are not provided, the localized wrinkles and distortions occur.

In one aspect of the present invention, the coefficient of expansion in the regions of the upper washing ribs 110 near the center of the upper pulsator 100 increases when grooves 170 are provided as illustrated in FIG. 4. Accordingly, the difference in the modulus of elongation of the pressed thin metallic plate forming the upper pulsator 100 can be resolved and the localized wrinkles and other distortions generated during the pressing may be prevented. When generation of the localized wrinkles and other distortions are prevented, the aesthetic appearance of the pulsator assembly is maintained and structural failure due to the inaccurate dimensions may be avoided.

Further, due to the presence of grooves 170 in the upper surface of the upper washing ribs 110, the surface area increases compared with pulsators of the related art. Moreover, when an external force substantially equal to that of the related art is applied, the stress per unit area of the upper pulsator 100 decreases and the structural rigidity of the upper pulsator 100 is maintained.

Still referring to FIG. 4, grooves 270 are provided in the upper surface of the lower washing ribs 210 adjacent the center of the lower pulsator 200, at regions corresponding to location of grooves 170 in the upper pulsator 100. The grooves 270 of the lower pulsator 200 conform substantially with the grooves 170 of the upper pulsator 100.

Figure 6:
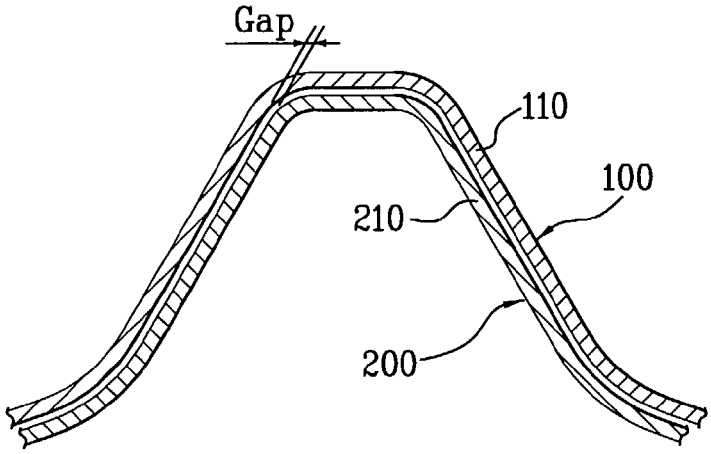
FIG. 6 illustrates a partial sectional view of a gap between the upper and lower pulsators.

According to the principles of the present invention, the pulsator assembly 400 is rotatable in forward and reverse directions during a washing operation. Therefore, water pressure is applied to the upper washing ribs 110 in an axial direction when the pulsator assembly 400 changes its rotational direction. However, and as shown in FIG. 6, the upper and lower pulsators 100 and 200 are not adhered to each other and, therefore, a small gap may exist between the lower surface of the upper pulsator 100 and the upper surface of the lower pulsator 200. The presence of the small gap may allow the upper and lower pulsators 100 and 200 to collide with each other when the rotational direction of the pulsator 400 changes or when a large amount of water is flowing over the upper pulsator 100. Because the upper and lower pulsators 100 and 200 may collide, an undesirable amount of noise may be generated and, if excessive, plastic deformation to the upper pulsator 100 may be caused. Further, a significant amount of horizontal movement relative to the upper and lower pulsators 100 and 200 may gradually increase, creating mechanical problems. Accordingly, the revised design of the pulsator assembly 400 illustrated in FIG. 4 may substantially prevent the relative movement from occurring.

Figure 7:
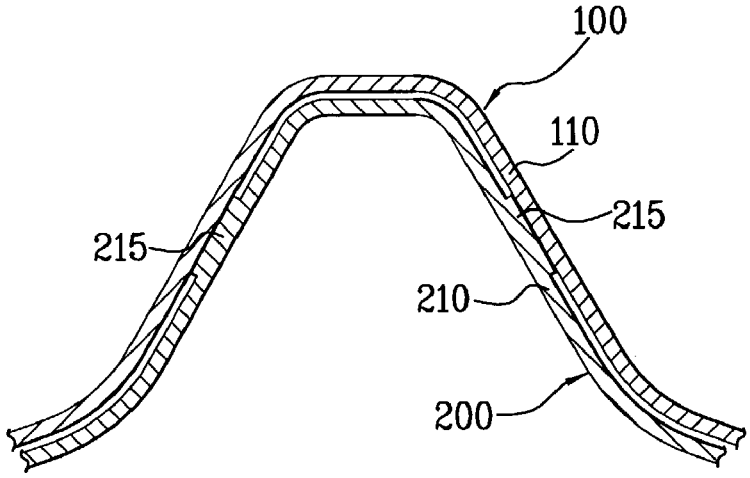
FIG. 7 illustrates a partial sectional view of a pulsator having protrusions.

Referring to FIG. 7, a structure may be provided for further preventing horizontal movement relative to the upper and lower pulsators 100 and 200. Accordingly, a plurality of protrusions 215 may be provided on the upper surface of the lower pulsator 200. In one aspect of the present invention, the plurality of protrusions may be formed on an outer surface of the lower washing ribs 210. The protrusions 215 may contact the lower surface of the upper pulsator 100 to thereby support the upper pulsator 100 during operation of the pulsator assembly 400. In one aspect of the present invention, the protrusions 215 may be provided substantially symmetrically on opposing sides of the lower washing ribs 210 of the lower pulsator 200. In another aspect of the present invention, the protrusions 215 may contact the lower surface of the upper pulsator 100 corresponding to the inner, lower surface of the upper washing ribs 110. According to the principles of the present invention, when the protrusions 215 are provided within the pulsator 400, the upper pulsator 100 does not move relative to the lower pulsator 200 even when a strong water pressure is applied to the outer surface of the upper pulsator 100, and the aforementioned problems are beneficially avoided. Although not shown in the Figure, the protrusions 215 may also be provided on the surface of the lower pulsator 200, exclusive of the lower washing ribs 210, and/or on circumferential side surfaces of the lower pulsator 200. In another aspect of the present invention, a cross-section of the protrusions 215 may be polygonal.

Figure 10:
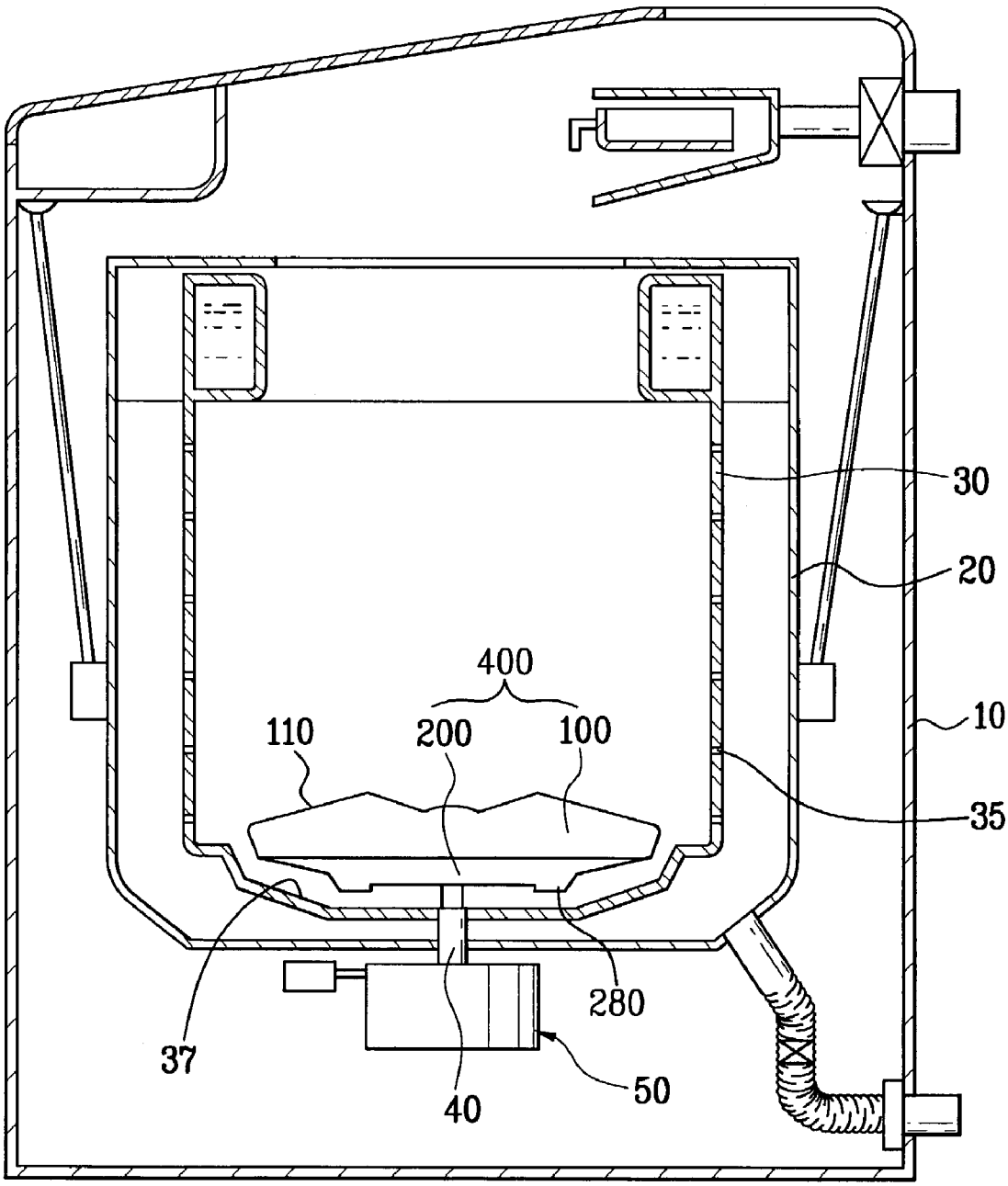
FIG. 10 illustrates a sectional view of a washing machine according to the principles of the present invention.

FIG. 10 illustrates a sectional view of a washing machine according to the principles of the present invention.

Referring to FIG. 10, a plurality of lower impellers 280 may be arranged adjacent the outlet 240 and protrude downwardly from the lower surface of the lower pulsator 200. Accordingly, water flowing from the outlet 240 may be pumped away from the center of the rotating pulsator assembly 400 using a centrifugal force. Principles of pumping water by the lower impellers 280 is similar to that of a general centrifugal pump and, therefore, a detailed description is hereby omitted.

Figure 5:
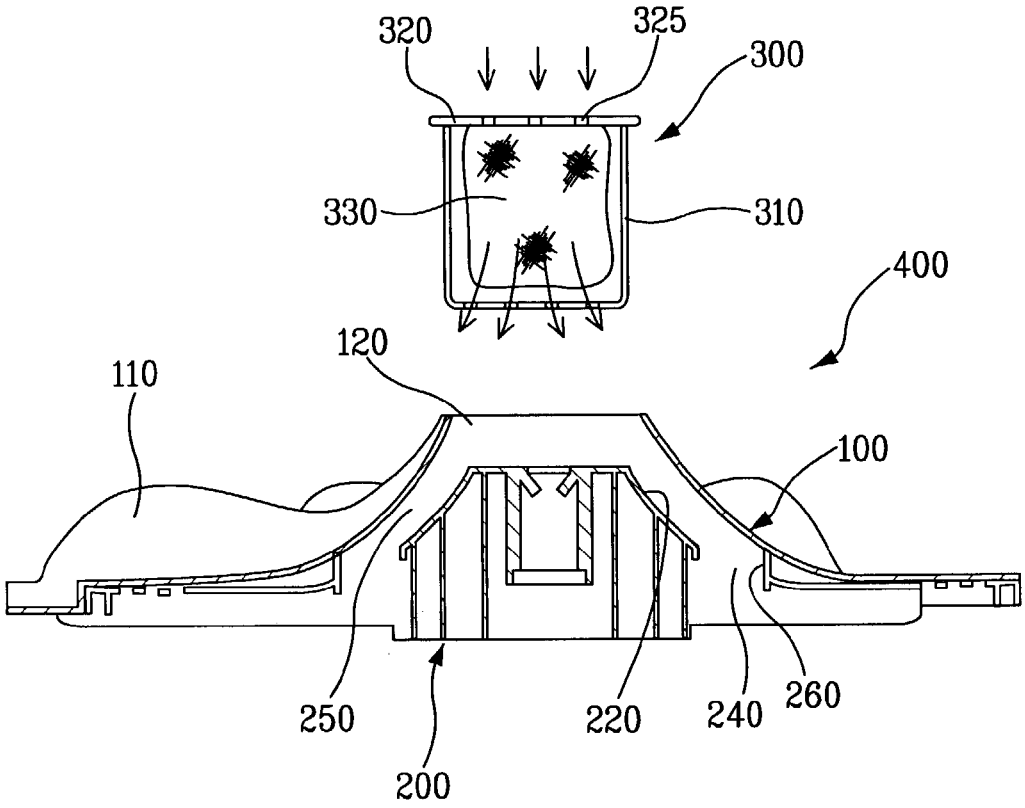
FIG. 5 illustrates a sectional view of the pulsator shown in FIG. 3 wherein a filtering unit is added to the pulsator.

Referring to FIG. 5, the pulsator 400 may further include a filtering unit 300. According to the principles of the present invention, the filtering unit 300 may be detachably fixable within the inlet 120 wherein the filtering unit 300 collects and removes lint contained in the water introduced into the inlet 120. In one aspect of the present invention, the filtering unit 300 may be variously implemented as described with reference to FIGS. 5, 8, and 9.

FIG. 5 illustrates a schematic view of a filtering unit 300 of a first aspect of the present invention installed within the inlet 120.

Referring to FIG. 5, the filtering unit 300 may, for example, include a cylindrical casing 310, a cap 320, and a collecting mesh 330. An upper portion of the cylindrical casing 310 may be opened. A lower portion of the cylindrical casing 310 may include a plurality of holes through which water may flow. The casing 310 may be detachably fixable to the inlet 120 via a hook (not shown). The cap 320 may be detachably fixable to the opened upper portion of the casing 310 via a hook (not shown). Further, the cap 320 may include inlet holes 325 through which both water and lint can pass. The collecting mesh 330 may comprise an upper opened portion arranged adjacent cap 320 inside the casing 310. When the filtering unit 300 described above is arranged within the inlet 120, lint contained in water may be collected in the collecting mesh 330 when water passes through the filtering unit 300 and is introduced into the inlet 120. Accordingly, the filtering unit 300 may effectively remove lint. If a large amount of lint is collected by the collecting mesh 330, the filtering unit 300 may be removed from the inlet 120 and the casing 310 and cap 320 may subsequently separated from each other. Next, the collecting mesh 330 may be removed and the collected lint may be extracted. After the collected lint is extracted from the collecting mesh 330, the filtering unit 300 may be reassembled and installed back into the inlet 120.

Figure 8:
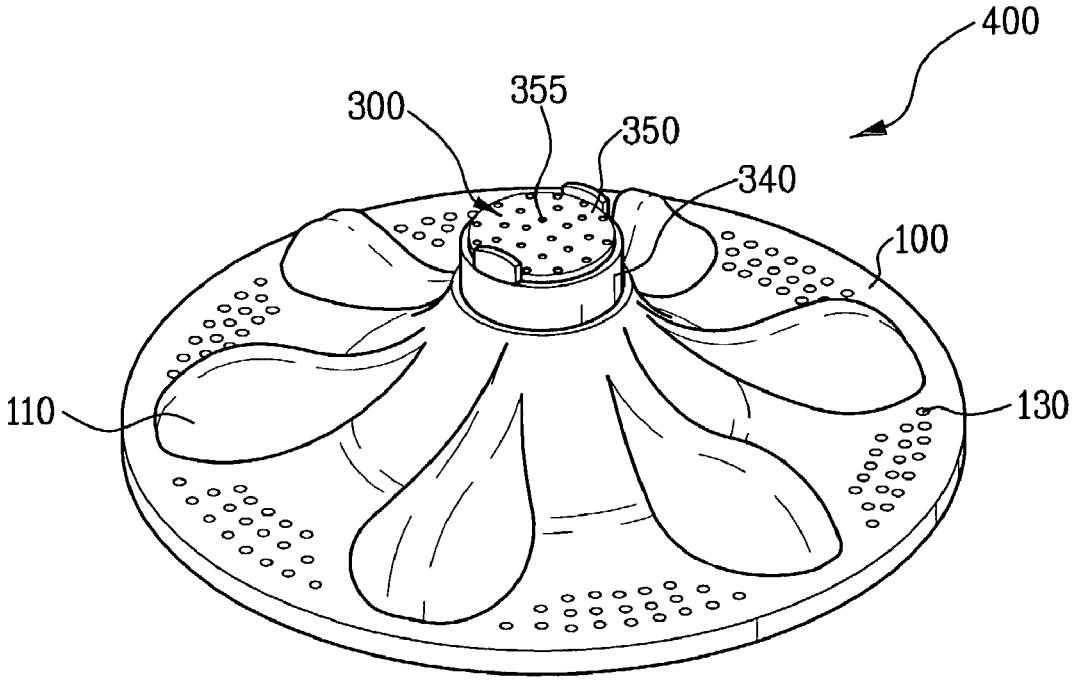
FIG. 8 illustrates a perspective view of the pulsator shown in FIG. 3 wherein a filtering unit is added to the pulsator.
Figure 9:
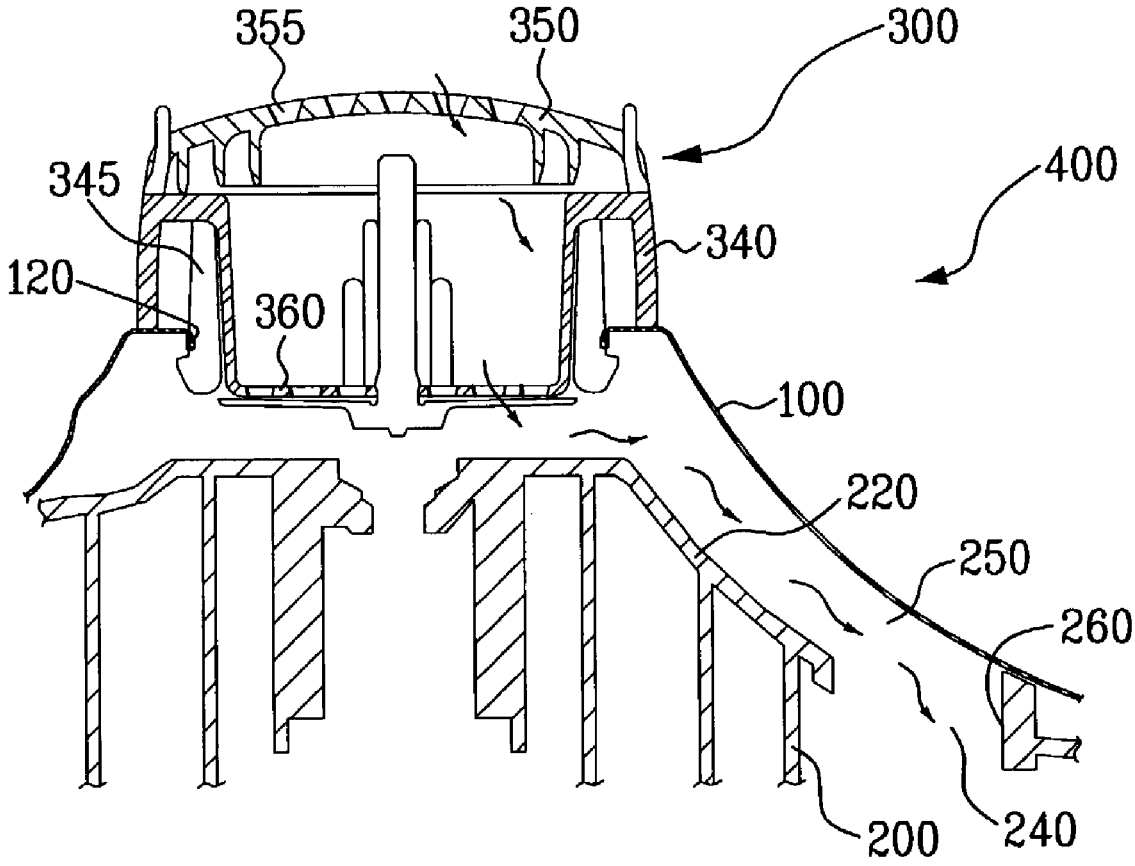
FIG. 9 illustrates a partial sectional view of the pulsator shown in FIG. 8.

FIGS. 8 and 9 illustrate a filtering unit 300 of a second aspect of the present invention installed within the inlet 120.

Referring to FIGS. 8 and 9, the filtering unit 300 may, for example, include a cylindrical casing 340, a cap 350, and a filter 360. The casing 340 may be detachably fixable to the inlet 120 via a hook 345 and may include an opened upper portion. A lower portion of the cylindrical casing 340 may be fully opened so that water can easily flow through the inlet 120 or may comprise a plurality of communication holes (not shown). The cap 350 may be detachably fixable to the opened upper portion of the cylindrical casing 340 and include a plurality of inlet holes 355 through which water and lint can flow. As shown in FIG. 9, the filter 360 may be provided in the lower portion of the casing 340 and collect and remove lint contained in water that is introduced into the casing 340 through the inlet holes 355 of the cap 350. The filter 360 may comprise a filtering means (e.g., screen, mesh, etc.) to collect lint from the water.

According to the principles of the present invention, the upper and lower pulsators 100 and 200 described above may be coupled together to form a pulsator assembly 400 arranged over a lower surface of an inner tub of a washing machine. The pulsator assembly 400 may be horizontally rotatable in forward and reverse directions about a driving shaft, to cause water within the inner tub to move both vertically and horizontally. The washing machine may perform a washing operation due to the vertical and horizontal movement of the water.

As the pulsator assembly 400 rotates, the upper washing ribs 110 directly contact the water, causing the water to move energetically in horizontal directions. As the pulsator assembly 400 rotates in one direction, the energy of the horizontal movement of the water increases and a whirlpool may be formed within the inner tub. As the intensity of the whirlpool increases, a water level at the center of the inner tub decreases while a water level at the circumference of the inner tub increases.

If the pulsator assembly 400 suddenly reverses its rotational direction, or is otherwise influenced by a disturbance in the water movement, water present at the higher water level may drop toward the center of the inner tub and a small amount of water may begin to move vertically. Moreover, water present at the center of the inner tub maybe introduced into the inlet 120 of the pulsator assembly 400, be channeled by the flow passage 250, and be discharged under the pulsator assembly 400 via outlet 240. Further, water in the washing machine may flows under the pulsator assembly 400 via the communication holes 130 and 230. Water found under the pulsator assembly 400 is pumped, by the strong force created by the lower impeller 280, away from the center of the pulsator assembly 400 toward the sidewall of the inner tub. Generally, portions of the inner tub where the bottom and the sidewall meet are provided as rounded edges such that water pumped by the lower impeller 280 is forced to the sidewall and then deflected upward toward the top of the washing machine along the rounded edges.

As the deflected water rises upward along the sidewall of the inner tub, the water level at the circumference of the inner tub increases, causing more water to drop toward the center of the inner tub where, as described above, the dropped water is conveyed toward the bottom of the inner tub, introduced into the inlet 120, and flows through the communication holes 130 and 230.

Accordingly, the pulsator assembly 400 of the present invention generate highly energetic vertical motion in water as well as highly energetic horizontal motion in water wherein the highly energetic vertical motion is attributable to, at least in part, the inlet 120, the flow passage 250, the outlet 240, and the lower impeller 280 of the pulsator assembly 400.

FIG. 10 illustrates a sectional view of a washing machine according to the principles of the present invention.

Referring to FIG. 10, the washing machine may, for example, include a cabinet 10, outer and inner tubs 20 and 30, respectively, a driving shaft 40, and the pulsator assembly 400 described above with respect to FIGS. 2 to 9. The cabinet 10 may form an outer shell, containing the various elements of the washing machine, and a cover or lid may be provided on an upper surface of the cabinet 10. The outer tub 20 may be provided inside the cabinet 10 and retain the water to be used during the washing operation. The inner tub 30 may be rotatably arranged inside the outer tub 20 and side portions of the inner tub 30 may include communication holes 35 allowing water to flow between the outer and inner tubs 20 and 30. The driving shaft 40 may penetrate the lower portions of the outer and inner tubs 20 and 30 and may be connected to a motor enabling it to rotate in forward and reverse directions. As described above, the pulsator assembly 400 may include an upper pulsator 100 made of metallic material and a lower pulsator 200 made of synthetic resin material.

As shown in FIG. 10, a bottom surface 37 of the inner tub 30, provided at the lower portion of the inner tub 30, may help generate energetic motion in the water along vertical directions by deflecting water pumped by the lower impeller 280 upwardly along the sidewall of the inner tub 30. The bottom surface 37 may be provided just below the pulsator assembly 400 and may accommodate the lower portion of the lower pulsator 200. In one aspect of the present invention, the bottom surface 37 may be separated from the lower and circumferential side surfaces of the pulsator assembly 400 by predetermined distances wherein water pumped by the lower impeller 280 is capable of being channeled between the lower and side surfaces of the pulsator assembly 400 and the bottom surface 37. Movement of the water pumped by the lower impeller 280 efficiently changes from substantially horizontal to substantially vertical due to the curved slope of the bottom surface 37. The bottom surface 37 generates an energetic vertical motion in the water along vertical directions more efficiently than compared to the rounded edge described above.

Figure 11:
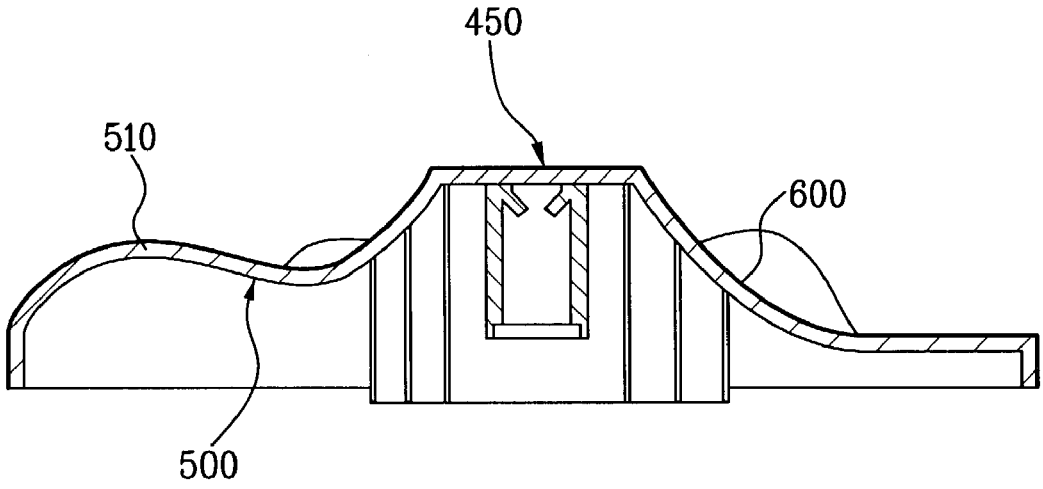
FIG. 11 illustrates a sectional view of a pulsator according to principles of a second aspect of the present invention.
Figure 12:
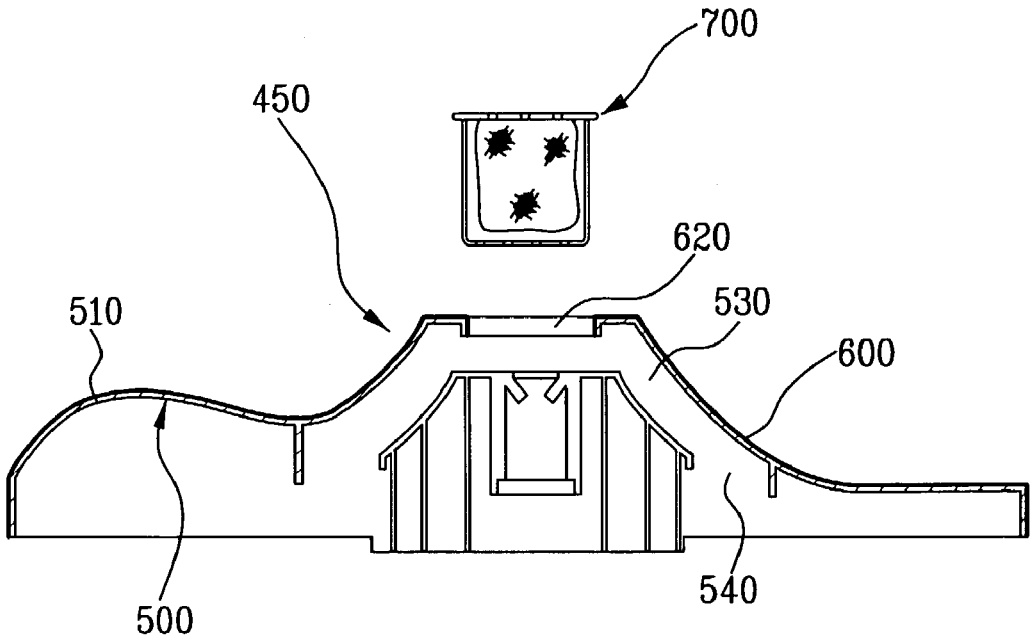
FIG. 12 illustrates a sectional view of the pulsator shown in FIG. 11 wherein a filtering unit is added to the pulsator.

FIGS. 11 and 12 illustrate a pulsator according to principles of a second aspect of the present invention Referring to FIGS. 11 and 12, the pulsator may, for example, include a pulsator body 500 formed of a synthetic resin material (e.g., a thermosetting plastic, etc.) and a metal plating layer 600 provided on the surface of the pulsator body 500.

In one aspect of the present invention, the pulsator body 500 may be fixed to a driving shaft, penetrating the lower portion of a tub, and rotatable in forward and reverse directions. The center portion of the upper surface of the pulsator body 500 may protrude upwardly, and a plurality of washing ribs 510 may radially extend from the center portion and protrude upwardly from the upper surface of the pulsator body 500.

In one aspect of the present invention, the metal plating layer 600 may be provided on the upper surface and on an outer circumferential surface of the pulsator body 500. The metal plating layer 600 may be made out of a metallic material such as chrome, etc., and be formed on the pulsator body 500 using any suitable technique such as a plating process, or according to the process described above in fabricating the upper pulsator 100 and assembling the pressed upper pulsator 100 to the lower pulsator 200, or any other suitable process.

Provided on the upper and outer circumferential surfaces of the pulsator body 500, the metal plating layer 600 enables the pulsator body 500 to have substantially the same surface finish as that of the inner tub, thereby enhancing aesthetic characteristics of the washing machine. Additionally, the chrome plating layer 600 does not discolor and has a strong resistance to deformation even when exposed to chemical products such as detergent. In one aspect of the present invention, the metal plating layer 600 may be provided with a high surface strength and a low coefficient of friction to prevent the formation of scratches and burrs. Therefore, laundry is not damaged even after the washing machine has been used for a long time, and the washing machine is highly reliable.

Referring to FIG. 12, the pulsator may further include an inlet 620, an outlet 540, and a flow passage 530. The inlet 620 may penetrate the metal plating layer 600 at the center portion 450 of the pulsator. The outlet 540 may be provided at a lower surface of the pulsator body 500. In one aspect of the present invention, the outlet 540 may be provided at portions adjacent the edge of the pulsator body 500. The flow passage 530 may be provided on an inner side of the pulsator body 500 and enable the inlet 620 to communicate with the outlet 540. Accordingly, similar to the pulsator assembly 400 described with reference to FIGS. 2 to 9, the pulsator illustrated in FIGS. 11 and 12 may generate highly energetic motion in the water along both vertical and horizontal directions.

Referring to FIG. 12, the pulsator may further include a filtering unit 700. In one aspect of the present invention, the filtering unit 700 may be detachably fixable within the inlet 620, collect lint contained in water introduced into the inlet 620, and be provided substantially as described with respect to the filtering units described with reference to FIGS. 5, 8, and 9.

Although not shown in FIG. 11 or 12, the pulsator of the present aspect of the invention may also include a plurality of communication holes penetrating both the pulsator body 500 and the metal plating layer 600, strength reinforcing grooves provided on the upper surface of the washing ribs, and the like, substantially as described above with respect to the pulsator assembly 400. However, since the pulsator illustrated in FIGS. 11 and 12 includes the metal plating layer 600 directly on the outer surface of the synthetic resin pulsator body 500, neither the bent edges nor the protrusions 215 of the pulsator assembly 400 are required.

Further, although not shown, a washing machine according to the present aspect of the invention may, for example, include a cabinet, a tub, a driving shaft, and other washing machine elements already described with reference to FIG. 10. Further, the washing machine may include a pulsator including the pulsator body 500 and the metal plating layer 600. Similar to the washing machine illustrated described with reference to FIG. 10, highly energetic vertical and horizontal motion in the water may be generated by the pulsator of the present aspect of the invention.

Use of the aforementioned pulsators and washing machines incorporating the aforementioned pulsators is advantageous for at least the following reasons.

First, since the upper surface of the pulsator is formed of metal material, the generation of scratches and burrs can be prevented. Therefore, laundry may be prevented from becoming damaged even when the washing machine is used for a long time. Accordingly, a washing machine having a high reliability may be obtained.

Second, the upper surface of the pulsator may be provided with a metallic quality and gloss similar to that of the inner tub. Accordingly, an aesthetic property of the washing machine can be increased.

Third, water within the inner tub may be introduced into the pulsator through the inlet provided at the center of the pulsator and may then be discharged to the lower portion of the pulsator. Therefore, it is possible to easily and efficiently create highly energetic motion in the water along both vertical and horizontal directions. For example, a portion of the horizontal motion in the water, formed by a pumping of a lower impeller at the lower portion of the lower pulsator, may be changed into vertical motion upon a deflection by the bottom surface of an inner tub, thereby efficiently generating highly energetic motion in the water along vertical directions. Accordingly, it is possible to provide a washing machine having an improved washing capability over related art washing machines.

Fourth, since the filtering unit provided at the inlet of the pulsator collects and removes the lint contained in water, it is possible to prevent the washing machine from failing to operate due to excessive amounts of lint. Further, it is unnecessary to provide other filtering units at the sidewall of the inner tub when the filtering unit of the present invention is employed.

Fifth, pulsator assemblies fabricated using the metallic upper pulsator and the synthetic resin lower pulsator may be provided with grooves for reinforcing the strength of the washing ribs and protrusions for preventing differential movements between the upper and lower pulsators, thereby improving a reliability in the pulsator assembly.

Sixth, pulsators fabricated using a synthetic resin body and the metal plating layer may have aesthetically pleasing appearances and be fabricated easily.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents. For example, the pulsator assembly 400 may not include lower washing ribs 210 if the upper pulsator 100 is sufficiently strong and does not need reinforcement from the lower pulsator 200.

What is claimed is:

1. A pulsator of a washing machine, comprising:

a metal upper pulsator, the upper pulsator comprising:

a center and a perimeter; an inlet arranged at the center of the upper pulsator;

a plurality of upwardly protruding upper washing ribs radiating away from the inlet toward the perimeter of the upper pulsator; and a first plurality of grooves formed in the plurality of upper washing ribs, wherein the grooves prevent localized wrinkle created due to a difference in a modulus of elongation during processing of the upper washing ribs; and a lower pulsator, the lower pulsator comprising:

a plurality of upwardly protruding lower washing ribs contactable by a lower surface of the upper washing ribs;

a guidance surface spaced apart from a lower surface of the upper pulsator and defining a flow passage provided between the lower surface of the upper pulsator and the guidance surface for channeling water introducible through the inlet; and an outlet at an end of the guidance surface for discharging water channeled by the flow passage, wherein the lower pulsator is rotatable and fixable to a driving shaft of a washing machine.

2. The pulsator of claim 1, wherein the metal comprises stainless steel.

3. The pulsator of claim 1, wherein the lower pulsator is of a synthetic resin material.

4. The pulsator of claim 1, wherein the upper pulsator further comprises an edge; and the lower pulsator further comprises an edge, wherein the edge of the upper pulsator is bent and fixed to enclose the edge of the lower pulsator such that the upper pulsator is substantially not inseparable from the lower pulsator.

5. The pulsator of claim 1, wherein the lower pulsator further comprises:

a lower surface; and a lower impeller protruding downwardly from the lower surface and adjacent the outlet for pumping water discharged from the outlet away from a center of the pulsator.

6. The pulsator of claim 1, wherein the flow passage is between the lower washing ribs.

7. The pulsator of claim 6, wherein the outlet is arranged adjacent a peripheral edge of the guidance surface.

8. The pulsator of claim 1, wherein the upper pulsator further comprises a first plurality of communication holes; and the lower pulsator further comprises a second plurality of communication holes, wherein the first plurality of communication holes are substantially aligned with the second plurality of communication holes and a space above the upper pulsator is in communication with a space below the lower pulsator via the first and second plurality of communication holes.

9. The pulsator of claim 8, wherein the first and second plurality of communication holes are arranged adjacent peripheral edges of the upper and lower pulsators.

10. The pulsator of claim 1, wherein the lower pulsator further comprises an upwardly protruding guidance rib contactable with a lower surface of the upper pulsator, the guidance rib arranged between the outlet and a peripheral edge of the lower pulsator for guiding water through the outlet and for preventing water from being introduced into an edge space between the upper and lower pulsators.

11. The pulsator of claim 1, further comprising:

a gap between an outer side surface of the lower washing ribs and an inner side surface of the upper washing ribs; and a plurality of protrusions protruding from the outer side surface of the lower washing ribs being contactable with an inner side surface of the upper washing ribs of the upper pulsator for substantially preventing the upper and lower pulsators from moving horizontally relative to each other.

12. The pulsator of claim 11, wherein the plurality of protrusions are formed on opposing ones of the outer side surfaces of the lower washing ribs and are substantially symmetric to each other.

13. The pulsator of claim 11, wherein the plurality of protrusions has a polygonal cross-section.

14. The pulsator of claim 1, further comprising protrusions at a surface of the lower pulsator, exclusive of the lower washing ribs, being contactable with an inner side surface of the upper pulsator for substantially preventing the upper and lower pulsators from moving horizontally relative to each other.

15. The pulsator of claim 1, further comprising a filtering unit detachably fixable within the inlet for collecting lint contained in water introducible within the inlet.

16. The pulsator of claim 15, wherein the filtering unit comprises:

a cylindrical casing detachably fixable within the inlet, the cylindrical casing comprising an opened upper portion;

a cap detachably fixable to the opened upper portion and having a plurality inlet holes; and a collecting mesh arranged within the casing for collecting the lint.

17. The pulsator of claim 16, wherein the cylindrical casing and the cap are detachably fixable within the inlet and to the cylindrical casing, respectively, by a hook.

18. The pulsator of claim 15, wherein the filtering unit comprises:

a cylindrical casing detachably fixable within the inlet, the cylindrical casing comprising a lower portion and an opened upper portion;

a cap detachably fixable to the opened upper portion and having a plurality inlet holes; and a filter provided at the lower portion of the cylindrical casing for collecting the lint.

19. The pulsator of claim 18, wherein the cylindrical casing and the cap are detachably fixable within the inlet and to the cylindrical casing, respectively, by a hook.

20. The pulsator of claim 1, further comprising a second plurality of grooves arranged within the plurality of lower washing ribs wherein the second plurality of grooves is substantially conformal to the first plurality of grooves.

21. A washing machine, comprising:

a cabinet;

a tub arranged in the cabinet;

a motor;

a driving shaft penetrating a bottom surface of the tub and being rotatable by the motor;

a metal upper pulsator, the upper pulsator comprising:

a center and a perimeter; an inlet arranged at the center of the upper pulsator;

a plurality of upwardly protruding upper washing ribs radiating away from the inlet toward the perimeter of the upper pulsator; and a first plurality of grooves formed in the plurality of upper washing ribs, wherein the grooves prevent localized wrinkle created due to a difference in a modulus of elongation during processing of the upper washing ribs; and a lower pulsator fixed to the driving shaft, the lower pulsator comprising:

a plurality of upwardly protruding lower washing ribs contactable by a lower surface of the upper washing ribs;

a guidance surface spaced apart from a lower surface of the upper pulsator and defining a flow passage of provided between the lower surface of the upper pulsator and the guidance surface for channeling water introducible through the inlet; and an outlet at an end of the guidance surface for discharging water channeled by the flow passage, wherein the lower pulsator is rotatable.

22. The washing machine of claim 21, wherein the metal comprises stainless steel.

23. The washing machine of claim 21, wherein the lower pulsator is of a synthetic resin material.

24. The washing machine of claim 21, wherein the bottom surface accommodates a lower portion of the lower pulsator.

25. The washing machine of claim 24, wherein the bottom surface is spaced apart from a peripheral surface of the upper and lower pulsators by a predetermined distance.

26. The washing machine of claim 25, wherein the lower pulsator further comprises:

a lower surface; and a lower impeller protruding downwardly from the lower surface and adjacent the outlet for pumping water discharged from the outlet through an area between the bottom surface and the peripheral surface of the upper and lower pulsators.

27. The washing machine of claim 21, wherein the upper pulsator further comprises a first plurality of communication holes; and the lower pulsator further comprises a second plurality of communication holes, wherein the first plurality of communication holes are substantially aligned with the second plurality of communication holes and a space above the upper pulsator is in communication with a space below the lower pulsator via the first and second plurality of communication holes.

28. The washing machine of claim 21, wherein the lower pulsator further comprises an upwardly protruding guidance rib contactable with a lower surface of the upper pulsator, the guidance rib arranged between the outlet and a peripheral edge of the lower pulsator for guiding water through the outlet and for preventing water from being introduced into an edge space between the upper and lower pulsators.

29. The washing machine of claim 21, further comprising:

a gap between an outer side surface of the lower washing ribs and an inner side surface of the upper washing ribs; and a plurality of protrusions protruding from the outer side surface of the lower washing ribs being contactable with an inner side surface of the upper washing ribs of the upper pulsator for substantially preventing the upper and lower pulsators from moving horizontally relative to each other.

30. The washing machine of claim 21, further comprising a filtering unit detachably fixable within the inlet for collecting lint contained in water introducible within the inlet.

31. The washing machine of claim 30, wherein the filtering unit comprises:

a cylindrical casing detachably fixable within the inlet, the cylindrical casing comprising an opened upper portion;

a cap detachably fixable to the opened upper portion and having a plurality inlet holes; and a collecting mesh arranged within the casing for collecting the lint.

32. The washing machine of claim 30, wherein the filtering unit comprises:

a cylindrical casing detachably fixable within the inlet, the cylindrical casing comprising a lower portion and an opened upper portion;

a cap detachably fixable to the opened upper portion and having a plurality inlet holes; and a filter provided at the lower portion for collecting the lint.

33. The pulsator of claim 21, further comprising a second plurality of grooves arranged within the plurality of lower washing ribs wherein the second plurality of grooves is substantially conformal to the first plurality of grooves.

34. A pulsator of a washing machine, comprising:

an upper pulsator, the upper pulsator comprising:

a circular body rotatably fixed to a bottom surface of a washing tub, the circular body comprising a metal plate having a predetermined thickness;

an upper washing rib protruding upwardly from the circular body for moving water movement along a rotational direction; and an upper groove arranged within the upper washing rib for preventing a localized wrinkle from being created due to a difference in a modulus of elongation during a processing of the upper washing rib; and a lower pulsator coupled to a lower surface of the circular body.

35. The pulsator of claim 34, wherein the lower pulsator is of a synthetic resin material.

36. The pulsator of claim 34, wherein the circular body comprises a center and a perimeter, wherein the upper washing rib extends from the center to the perimeter, wherein a portion of the upper washing rib proximate the perimeter is more convex than a portion of the upper washing rib proximate the center, and wherein the groove is formed proximate the center.

37. The pulsator of claim 34, wherein the lower pulsator further comprises:

a lower washing rib contactable by a lower surface of the upper washing rib; and a lower groove formed in the lower washing rib wherein the lower groove is substantially conformal to the upper groove.

38. The pulsator of claim 37, further comprising:

a gap between an outer side surface of the lower washing ribs and an inner side surface of the upper washing ribs; and a plurality of protrusions protruding from the outer side surface of the lower washing ribs being contactable with an inner side surface of the upper washing ribs of the upper pulsator for substantially preventing the upper and lower pulsators from moving horizontally relative to each other.

39. The pulsator of claim 34, wherein the upper pulsator further comprises an inlet formed at the center; and the lower pulsator further comprises:

a guidance surface spaced apart from a lower surface of the upper pulsator and defining a flow passage provided between the upper pulsator and the guidance surface for channeling water introducible through the inlet; and an outlet at an end of the guidance surface for discharging water channeled by the flow passage.

40. The pulsator of claim 39, wherein the lower pulsator further comprises:

a lower surface; and a lower impeller protruding downwardly from the lower surface and adjacent the outlet for pumping water discharged from the outlet away from a center of the lower pulsator.

41. The pulsator of claim 39, wherein the lower pulsator further comprises an upwardly protruding guidance rib contactable with a lower surface of the upper pulsator, the guidance rib arranged between the outlet and a peripheral edge of the lower pulsator for guiding water through the outlet and for preventing water from being introduced into an edge space between the upper and lower pulsators.

42. The pulsator of claim 39, further comprising a filtering unit detachably fixable within the inlet for collecting lint contained in water introducible within the inlet.

43. The pulsator of claim 42, wherein the filtering unit comprises:

a cylindrical, casing detachably fixable within the inlet, the cylindrical casing comprising an opened upper portion;

a cap detachably fixable to the opened upper portion and having a plurality inlet holes; and a collecting mesh arranged within the casing for collecting the lint.

44. The pulsator of claim 42, wherein the filtering unit comprises:

a cylindrical casing detachably fixable within the inlet, the cylindrical casing comprising a lower portion and an opened upper portion;

a cap detachably fixable to the opened upper portion and having a plurality inlet holes; and a filter provided at the lower portion for collecting the lint.

45. The pulsator of claim 34, wherein the upper pulsator is formed of stainless steel.

46. The pulsator of claim 34, wherein the upper pulsator further comprises a first plurality of communication holes; and the lower pulsator further comprises a second plurality of communication holes, wherein the first plurality of communication holes are substantially aligned with the second plurality of communication holes and a space above the upper pulsator is in communication with a space below the lower pulsator via the first and second plurality of communication holes.

47. A pulsator of a washing machine, comprising:

a rotatable lower part; and an upper part made of a metallic material, provided on the lower part and comprising a plurality of washing ribs protruding upwardly for making water movement in a tub of the washing machine, the plurality of washing ribs having a plurality of grooves arranged thereon, wherein the plurality of grooves prevent localized wrinkle due to a difference in a modulus of elongation during processing of the washing ribs.

48. A washing machine comprising:

a cabinet;

a tub provided in the cabinet;

a motor provided in the cabinet; and a rotatable pulsator driven by the motor and provided on a bottom of the tub, the pulsator comprising:

a lower part driven by the motor; and an upper part made of a metallic material, provided on the lower part and comprising a plurality of washing ribs protruding upwardly for making water movements in the tub of the washing machine, the plurality of washing ribs having a plurality of grooves arranged thereon, wherein the grooves prevent localized wrinkle due to a difference in a modulus of elongation during processing of the washing ribs.

* * * * *